United States Patent [19]

Westfall et al.

[11] Patent Number: 4,702,676

[45] Date of Patent: Oct. 27, 1987

[54] LIQUID DRIVEN PUMP OR PROPULSIVE APPARATUS

[75] Inventors: Alan P. Westfall, Calgary; Robert J. Roe, Richmond, both of Canada

[73] Assignee: Canadian Patents and Development Limited, Ottawa, Canada

[21] Appl. No.: 786,628

[22] Filed: Oct. 11, 1985

Related U.S. Application Data

[63] Continuation-in-part of Ser. No. 661,223, Oct. 15, 1984, abandoned.

[51] Int. Cl.[4] ..... F04F 5/22

[52] U.S. Cl. ..... 417/87; 43/4.5; 43/6.5; 417/90; 417/179; 417/181; 417/197; 417/198

[58] Field of Search ..... 119/3; 43/4, 4.5, 6.5; 417/87, 90, 196, 197, 198, 169, 179, 180, 181

[56] References Cited

U.S. PATENT DOCUMENTS

| | | | |
|---|---|---|---|
| 284,962 | 9/1883 | Huston | 417/197 |
| 631,007 | 8/1899 | Farrar | 417/197 X |
| 3,655,298 | 4/1972 | Baker . | |
| 3,857,651 | 12/1974 | Bruno . | |
| 4,028,009 | 6/1977 | Gudzenko et al. . | |
| 4,155,682 | 5/1979 | Hillis . | |
| 4,379,679 | 4/1983 | Guile . | |
| 4,558,990 | 12/1985 | Roach | 417/87 |

FOREIGN PATENT DOCUMENTS

| | | | |
|---|---|---|---|
| 521176 | 7/1921 | France . | |
| 1410801 | 8/1965 | France . | |
| 41500 | 4/1981 | Japan | 417/87 |
| 160825 | 10/1982 | Japan | 43/6.5 |
| 188099 | 3/1985 | Japan . | |
| 117668 | 8/1969 | Norway | 43/6.5 |
| 101872 | 11/1923 | Switzerland . | |
| 852298 | 8/1981 | U.S.S.R. | 417/87 |

*Primary Examiner*—Edward K. Look
*Attorney, Agent, or Firm*—Carver & Co.

[57] ABSTRACT

The apparatus relates to a jet pump or apparatus which displaces a main fluid by a pressurized driving liquid. The apparatus has a duct to receive the main fluid, and a driving liquid manifold cooperating with the duct to receive the pressurized driving liquid. First and second sets of inwardly facing jet nozzles are disposed adjacent a transverse plane of the duct and penetrate the duct side walll to pass the driving liquid into the duct at a mixing portion of the duct having a constant cross-sectional area. The first and second sets of jet nozzles are inclined at angles to the duct axis so that the first nozzles are inclined at a greater angle than the second nozzles. Efficiency of the pump is improved by admitting pressurized gas into the duct and providing the pump with a diverging outlet portion to act as diffuser.

11 Claims, 7 Drawing Figures

FIG. 1
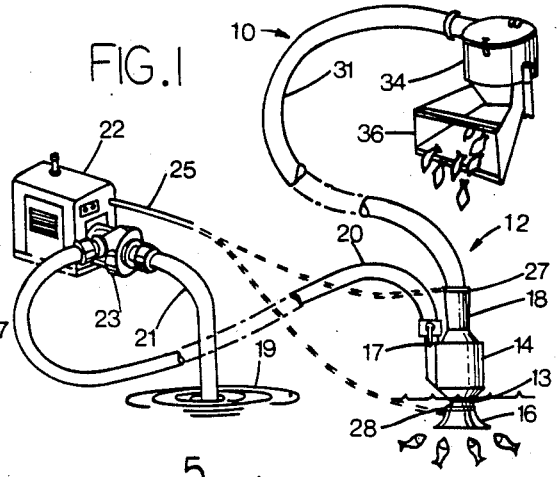
FIG. 2
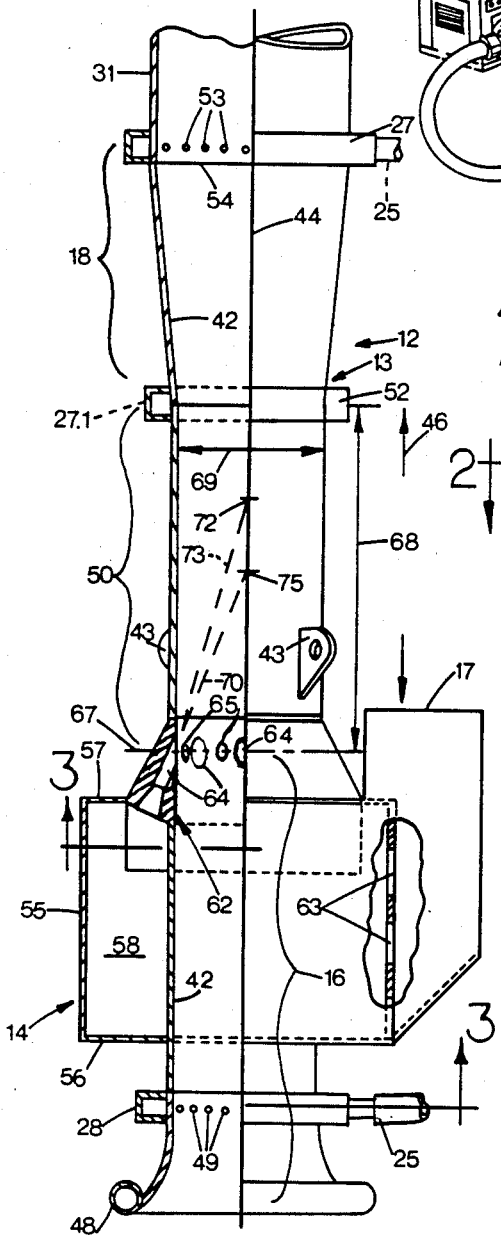
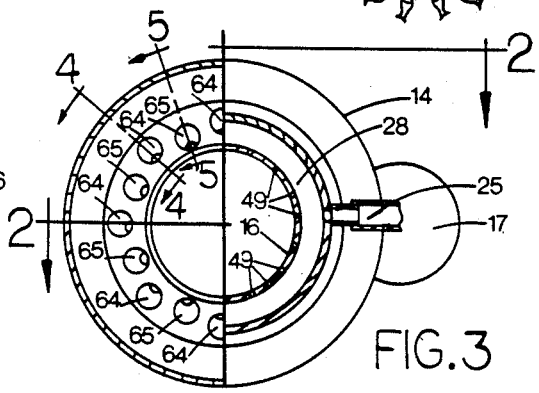
FIG. 3
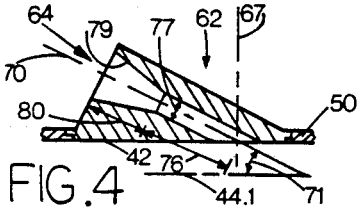
FIG. 4
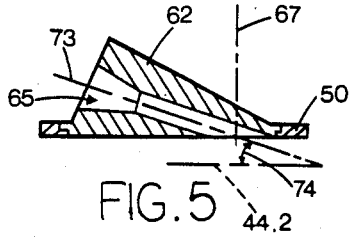
FIG. 5

LIQUID DRIVEN PUMP OR PROPULSIVE APPARATUS

CROSS REFERENCES TO RELATED APPLICATION

This is a continuation-in-part of our co-pending application Ser. No. 06/661,223, filed 15 OCT. 1984, entitled JET PUMP now abandoned.

BACKGROUND OF THE INVENTION

1. Field of the Invention

The invention relates to a propulsive apparatus for displacing a main fluid within a duct, and resembles a jet pump or ejector pump as used for pumping fluids, or solids suspended in fluids.

2. Prior Art

Jet pumps or ejector pumps have been used for many years and are characterised by a duct into which one or more jets of driving liquid are directed. The driving liquid propels the main fluid within the duct by transfer of the momentum of the driving liquid to the main fluid. The present invention relates to a particular type of jet pump known as a "peripheral jet pump", in which a series of jets are spaced around the periphery, thus leaving the centre of the duct free of obstructions. This permits the pump to pump objects suspended in the main fluid having a maximum size which is slightly less than cross-section of the duct. Many applications for this type of pump have been devised, such as pumping fish, fruit, or vegetables or other objects that are fragile and would be damaged by other types of pumps or conveying systems.

In general, prior art jet pumps are characterised by relatively low efficiency when compared with conventional fluid pumps, but this low efficiency is tolerated for the benefits of relatively gentle handling of delicate solids. The low efficiency of prior art jet pumps requires the use of relatively high powered units to pump the driving liquid, and this results in high energy costs and considerable space requirements where the pump is to be used. When such pumps are used for pumping fish on small fishing boats, the size of the power plant necessary to power the driving liquid can become excessive and thus limits the use of such pumps. An example of an ejector pump using two sets of jet nozzles inclined at different angles to the duct axis and spaced along the axis is shown in U.S. Pat. No. 4,155,682, issued to Hillis. Spacing between the two sets of jet nozzles increases length of the jet pump necessary for mixing of the fluids, and use of two separate sets of nozzles increases cost of the pump.

The height to which the pump can maintain a column of water is limited by pump efficiency and available power. When using various types of pumps, it is known to inject air into the column of water and fish as it is drawn from a fish net or hold of a boat. The injected air reduces effective density of the liquid or liquid/solid mixture within the column and this is commonly called an "air assist" lift pump. An example of a fish pump using air assist is shown in U.S. Pat. No. 2,736,121, issued to Kimmerle. This pump is characterised by complexity, and therefore cost and the number of parts which can damage fish drawn through the pump. A pump using air assist in combination with a jet pump is shown in Japanese publication No. 56-41500, but this has a central obstruction in the duct which limits size of product being handled and also could damage the product.

SUMMARY OF THE INVENTION

The present invention reduces the difficulties and disadvantages of the prior art by providing a propulsive apparatus or jet pump with improved efficiency, which permits a reduction in the size of power unit for moving a given amount of fluid, or alternatively increases the height to which a fluid can be drawn. This improvement in efficiency is attained without increasing complexity of the apparatus, because most of the apparatus has basically no moving parts. Similarly to prior art peripheral jet pumps, the invention provides a duct without obstruction, thus permitting movement of solids having a maximum size slightly less than the size of the duct. Furthermore, pressure of the working liquid is relatively low, so that impingement of the working liquid on the solids causes negligible damage. Air assist in combination with a diverging or diffusing outlet portion further improves lift capability.

A propulsive apparatus according to the invention is for displacing a main liquid and includes a duct, a driving liquid manifold and first and second sets of inwardly facing jet nozzles. The duct extends along a duct axis and is for receiving the main liquid, and has a duct side wall to define in part a mixing portion having a constant cross-sectional area. The duct side wall also defines in part inlet and outlet portions spaced on upstream and downstream sides respectively of the mixing portion. The driving liquid manifold cooperates with the duct and is adapted to receive pressurised driving liquid. The jets nozzles are disposed adjacent a transverse plane of the duct, and cooperate with the duct side wall and the manifold to pass the driving liquid into the mixing portion. The nozzles have outlets essentially flush with the side wall and are spaced equally from the duct axis. The first and second sets of jet nozzles have respective first and second jet axes inclined at respective first and second angles to the ducts axis, in which the first angle is greater than the second angle. The first and second sets of jet nozzles alternate with each other and extend peripherally around the side wall so that at least one nozzle of the first set alternates with at least one nozzle of the second set. The two sets of jet nozzles have a total cross-sectional area which is within a range of approximately 3% to 15% of the cross-sectional area of the mixing portion. By positioning the two sets of nozzles in the same diametrical plane, mixing of the jets of driving fluid with the main fluid occurs in a shorter space, thus permitting reduction in length of the apparatus and manufacturing costs by having only one ring of nozzles.

In one embodiment a gas manifold cooperates with the duct and is adapted to receive pressurised gas. This embodiment also includes a plurality of gas nozzles cooperating with the duct side wall and the gas manifold to pass the gas into at least one of the duct portions. To improve performance, the outlet portion diverges downstream from the mixing portion so as to have a larger cross-sectional area than the mixing portion.

A detailed disclosure following, related to drawings, describes a preferred embodiment of the invention which is capable of expression in structure other than that particularly described and illustrated.

DESCRIPTION OF THE DRAWINGS

FIG. 1 is a simplified perspective of a propulsive apparatus according to the invention incorporated into a system for pumping fish from a net etc, into a container, FIG. 2 is a simplified fragmented section on a longitudinal axial plane of the apparatus, as would be seen on line 2—2 of FIG. 3, FIG. 3 is a simplified transverse section of the apparatus, as seen on line 3—3 of FIG. 2, FIG. 4 is a simplified fragmented section of a first jet nozzle on line 4—4 of FIG. 3, FIG. 5 is a simplified fragmented section of a second jet nozzle on line 5—5 of FIG. 3, FIG. 6 are experimental performance curves comparing a pump of the invention with a generally similar prior art pump having jet nozzles all of the same angle, FIG. 7 are experimental performance curves comparing improvements in performance of a pump of the invention with and without air assist and a diffusing outlet portion.

DETAILED DISCLOSURE

FIG. 1

Figure 6:
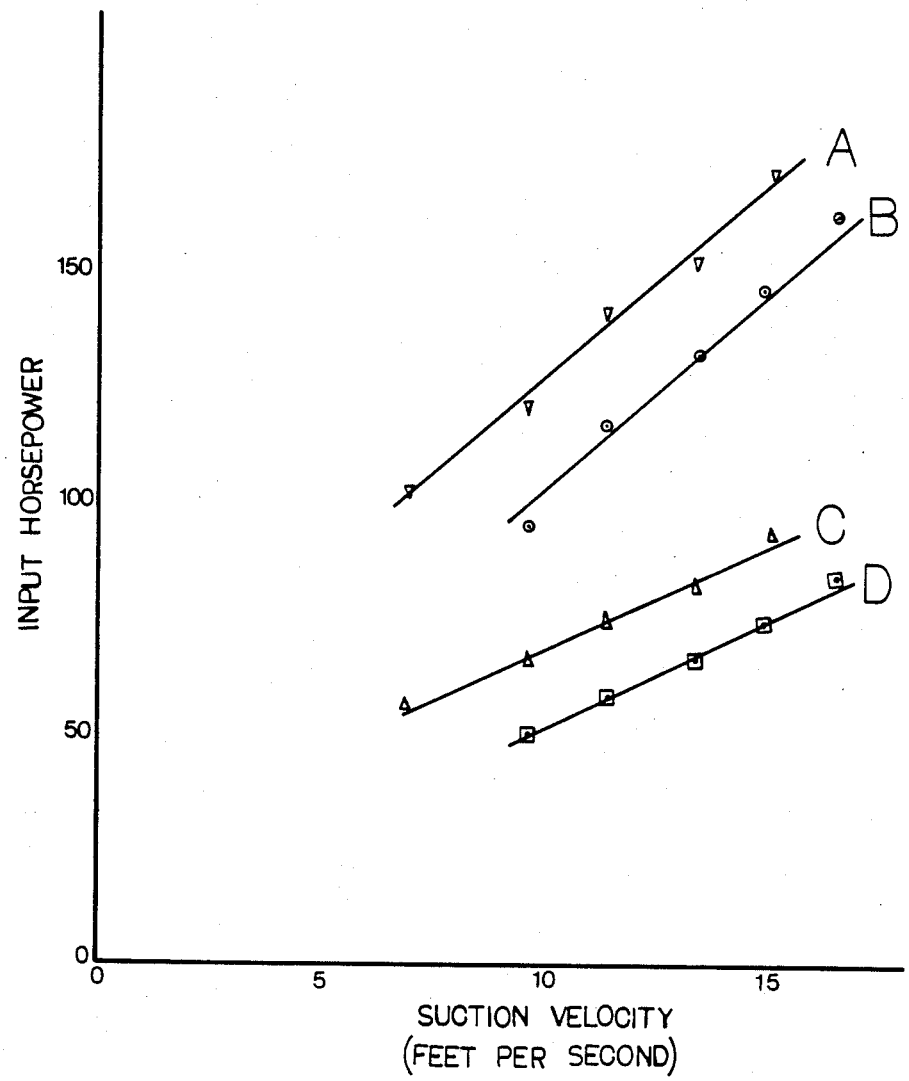

A fish pump system 10, adapted particularly for use on the deck of a fishing vessel, not shown, utilises a propulsive apparatus 12 according to the invention. The apparatus 12 has a duct 13, a driving liquid manifold 14, and inlet and outlet portions 16 and 18 respectively which are disposed on upstream and downstream sides respectively of the manifold. The manifold 14 has a manifold inlet 17 which receives pressurised driving liquid i.e., water, through a manifold delivery pipe 20. An engine 22 drives a liquid pump 23 which supplies pressurised water to the delivery pipe 20. The pump receives water through a water supply or suction hose 21 which draws water from a convenient body of water 19 which is usually surrounding the fishing vessel. However, when unloading in a harbour where water might be polluted, a separate supply of cleaner water might be required.

The engine 22 also drives an air compressor, not shown, which delivers compressed air through an air delivery pipe 25 which feeds air to an air assist or gas manifold 27 surrounding the outlet portion 18 i.e., air is injected on a downstream side of the apparatus 12. If desired, an alternative air assist or gas manifold can be fitted adjacent the inlet portion 16 of the duct, as shown at 28, and thus is fitted on the upstream side of the propulsive apparatus 12. The air delivery pipe 25 is shown partially in broken outline for supplying air to both the downstream located manifold 27, and/or the upstream located manifold 28 or to other locations to suit particular requirements. The outlet portion 18 discharges water and fish into a transfer duct 31, which in turn is connected to a deceleration/dewatering unit 34 which separates solids, that is the fish, from the water, the fish being discharged through a discharge chute 36.

FIGS. 2 through 5

Referring mostly to FIG. 2, the duct 13 has a duct side wall 42 extending along and surrounding a duct longitudinal axis 44. A pair of diametrically opposed lugs 43 extend from the side wall 42 for supporting the duct with cables, etc, not shown. As shown in FIG. 1, the duct is mounted so that the axis 44 is generally vertical, and water flows from the inlet portion 16 per an arrow 46 through the outlet portion 18 and into the hose 31. The duct 13 has a central or mixing portion 50 of constant cross-sectional area, i.e., the central portion of the duct is parallel sided, and extends between the inlet portion 16 and the outlet portion 18. Thus it can be seen that the duct side wall 42 defines in part the inlet and outlet portions 16 and 18 spaced on upstream and downstream sides respectively of the mixing portion 50. Most of the inlet portion is of the same cross-sectional as the mixing portion, i.e., is also parallel sided. However, an upstream opening 48 of the inlet portion 16 is flared so as to present a "bell-mouth" of larger diameter than the central portion to facilitate smooth entry of water thereinto. The manifold 28 extends around the inlet portion 16 and a plurality of openings 49 penetrate the duct side wall to serve as gas nozzles to direct gas from the manifold into the inlet portion of the duct. For a 12 inch (305 mm) diameter duct, 32 openings of 0.25 inches (6.35 mm) diameter are adequate. While the duct axis 44 can be at inclinations other than vertical, if air assist is used care must be taken to reduce chances of air collecting in the hose.

The outlet portion 18 is a hollow frustum and has an upstream edge of the same diameter as the central portion secured with releasable clamp means 52 to the central portion 50 of the duct for convenience of assembly and storage. The transfer hose 31 has a larger diameter than the mixing portion 50, and thus the outlet portion 18 diverges downstream from the mixing portion to a downstream edge 54 which cooperates smoothly with the hose 31. The outlet portion 18 preferably has a maximum total angle of about 30° for reduction of flow velocity with minimum losses. Preferably the outlet portion 18 causes an increase in cross-sectional duct area of between 50 to 100% of the duct cross-sectional area at the mixing portion 50, and this is considered important for improved lift when used in conjunction with air injection. The manifold 27 is positioned adjacent the edge 54, i.e., at the junction between the hose 31 and the outlet portion 18, although it could be located at an intersection between the mixing portion 50 and outlet portion 18, as shown in broken outline at 27.1. Generally it is more convenient to locate the gas injection manifold remote from the clamp means 52. In either location of the manifold 27, i.e. adjacent downstream (27) or upstream (27.1) portions of the outlet portion, similarly to the manifold 28, a plurality of gas nozzles 53 penetrate the duct side wall to pass gas from the manifold into the gas outlet portion.

The driving liquid manifold 14 has a tubular portion 55, and annular upstream and downstream end plates 56 and 57 which enclose the duct side wall 42 to form an annular chamber 58. The manifold delivery pipe 20 cooperates with the manifold inlet 17 which is secured parallel to the duct 13 as shown. The tubular portion 55 has a pair of openings 63 which provide communication between the manifold inlet 17 and the annular chamber 58 defined by the manifold. Flow losses are reduced by having the manifold 14 much larger in cross-section that the duct 13. An annular nozzle ring 62 forms a portion of the duct side wall 42 and cooperates with the downstream end plate 57 as seen in FIG. 2. The ring 62 has first and second sets of inwardly facing jet nozzles 64 and 65 disposed adjacent a transverse diametrical plane 67 of the duct. It can be seen that the jet nozzles cooperate with the duct side wall and the manifold 14 to pass the driving liquid into the mixing portion 50. Preferably the mixing portion 50 has a minimum mixing length 68 of about 3 times its diameter 69, measured from the diametrical plane 67 containing the jet nozzles to the beginning of the outlet portion 18, that is the intersection between the portions 18 and 50. This is to permit some mixing of the driving liquid with the main fluid prior to entering the outlet portion 18 which acts as a diffuser.

As seen in FIG. 4, a typical first jet nozzle 64 has a first axis 70 inclined to the duct axis, shown diagrammatically transposed at 44.1, at a first angle 71 as shown. Similarly, as seen in FIG. 5, a typical second jet nozzle 65 has a second jet axis 73 inclined at a second angle 74 to the duct axis, as shown diagrammatically transposed at 44.2. As seen in FIG. 3, the first and second sets of jet nozzles 64 and 65 are positioned peripherally around the side wall so as to alternate with each other. For best performance, the first angle 71 of the first set of nozzles 64 is between about 15° and 30°, and the second angle of the second set of nozzles 65 is between 10° and 20°. Also, the first angle is always greater than the second angle, and preferably the first and second angles are separated by no less than about 5 degrees. As seen in FIG. 2, the first and second jet axes converge inwardly to intersect the duct axis 44, and all axes pass through the common diametrical plane 67 adjacent the side wall 42. Because of the difference in angles between the two sets of nozzles, the axes 73 of the second set of jet nozzles intersect the duct axis 44 at an intersection 72 positioned downstream from an intersection 75 of the axis 44 with axes 70 of the first set of jet nozzles. Furthermore both sets of jet nozzles penetrate the duct side wall 42 smoothly, without a step in the side wall or a change in duct diameter. That is, outlets from the nozzles are essentially flush with the duct side wall and are spaced equally from the duct axis. This is considered to reduce turbulence considerably when compared with nozzles of the prior art which are commonly located in steps on the side wall. A side wall without steps reduces flow losses in the main flow as it passes the nozzles because there is no significant change in duct diameter across the jet nozzles. A smooth duct side wall, adjacent joins in the duct portions as well as adjacent the nozzles, is important also to reduce or eliminate possible damage to the product i.e., fish, being handled.

The angles specified above represent ranges of angles with acceptable limits of angles for pumping fish. Improved pumping efficiency is attained when the first angle is between 18° and 25°, the second angle is between 12° and 19°, and the first and second angles are within a range of between 5° and 10° of each other. As will be described, the graphical results presented in FIGS. 6 and 7 relate to an improved pump in which the first angle is 25° and the second angle is 18°.

Referring again to FIG. 4, the first jet nozzle 64 has a jet length 76 measured along the axis 70, and a parallel jet bore 77, being the narrowest diameter of the jet nozzle. Preferably, the ratio of the jet bore diameter to jet length i.e., jet bore:jet length, is between 1:2 and 1:6, although variations outside this range are permitted for certain liquids. It is added that a shorter jet length to bore ratio would tend to result in a spray of driving liquid from the nozzle which diverges too rapidly, and thus loses momentum too quickly with consequent loss of pumping efficiency. A larger ratio would likely result in a jet that focuses driving liquid too sharply, causing impact damage to a delicate product being pumped. The nozzle 64 has an entrance cone 79 which converges inwardly to meet the jet bore. Preferably, the entrance cone 79 has a length 80 that is approximately three times the jet bore 77. Preferably, the entrance cone has an included angle of about 15° to 25° to reduce losses. The second jet nozzles 65 are generally similar in geometry to the first jet nozzles, with of course the exception of the more shallow angle of inclination to the duct axis 44.

An important factor to consider is the overall cross-sectional area of the jet nozzles when compared with the overall duct cross-sectional area in the mixing portion 50. Preferably, the two sets of jet nozzles 64 and 65 have a total cross-sectional area which is within a range of approximately 3% to 15% of the cross-sectional area of the central or mixing portion 50. In the example shown, there is a jet nozzle positioned every 22.5 degrees around the periphery of the nozzle ring 62. Thus there are eight first jet nozzles and eight second jet nozzles spaced equally apart. To be within the jet nozzle/duct cross-sectional area ratio above, for a duct having a diameter of 8 inches (203 mm), each nozzle has a jet bore diameter of between 0.346 inches (8.79 mm) and 0.775 inches (19.69 mm). If the said cross-sectional area ratio is much smaller than 3%, the pump effectiveness would be reduced considerably unless very high driving liquid pressures were used which might damage the product. If the cross-sectional area ratio were much larger than 15%, the manifold pipe 20 would be exceptionally large, and much power would be required by the pump 23 to supply adequate volume flow of driving liquid.

OPERATION

Figure 7:
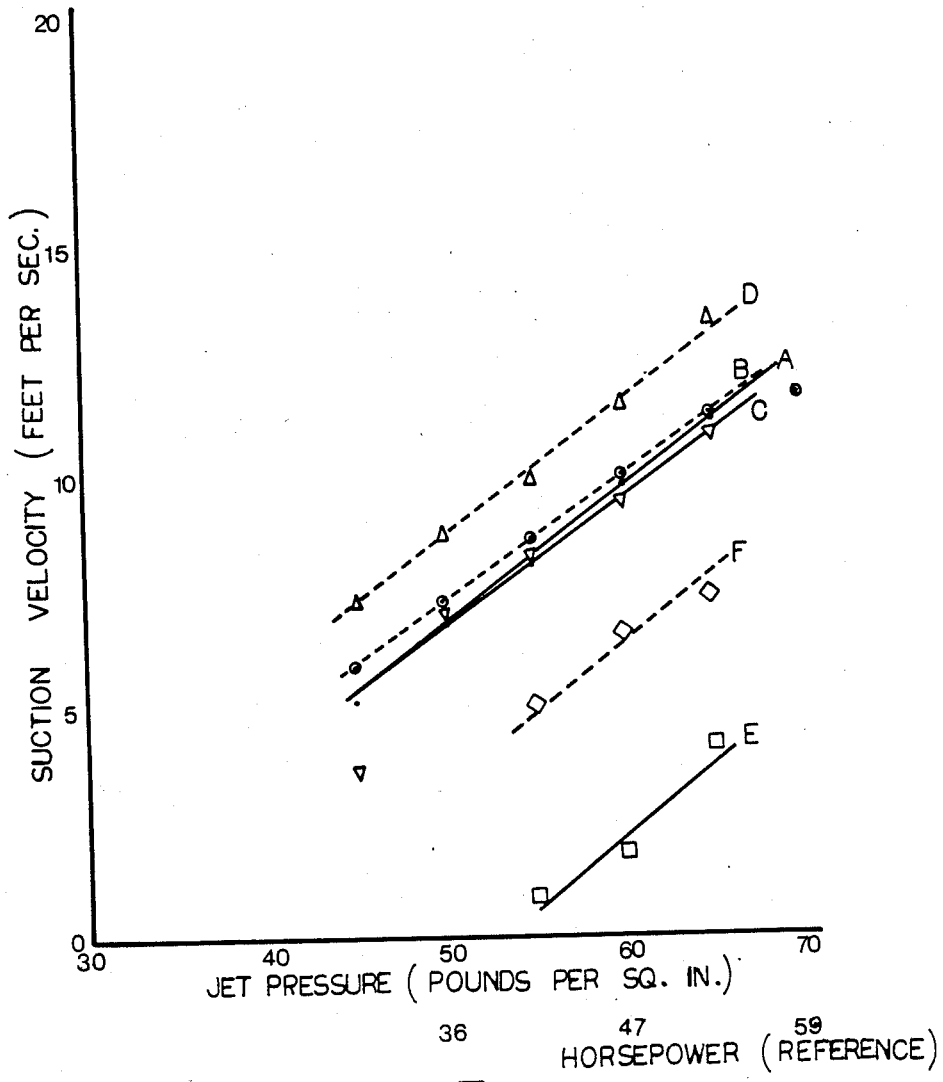

In operation, referring mostly to FIG. 1, the apparatus 10 is positioned by hanging from the lifting lugs 43 so that the inlet portion 16 is immersed in the fish net or hold of a ship containing fish to be pumped, or other liquid or liquid/solid material to be pumped. The pump 23 supplies water under pressure to the manifold 14, and the sets of nozzles 64 and 65 (FIG. 2) direct a plurality of jets of high pressure water into the duct 13. The jets from the nozzles induce a flow of main fluid in direction of the arrow 46 up the duct, by transferring momentum from the jets themselves to the main fluid and solids suspended within the fluid. For improved performance, air is admitted from the air delivery pipe 25 into either the manifold 27 or 28, or both, although it would seem that best results have been obtained by admitting air into the manifold 28. When using air assist lift, it has been found best when this is used in conjunction with the diverging outlet portion, as shown at 18. The diverging outlet portion 18 acts as a diffuser and reduces speed of the flow through the duct, and as seen in FIG. 7, admission of air into the duct appears to increase considerably the lift that was available from this type of pump. Water and fish within the water are passed along the duct 31 to the decelerating/dewatering device 34, and fish are rejected from the chute 36, while water is returned to the body of water 19 for re-use if required, or to waste.

Operating parameters vary considerably depending on the product being handled, and height to which the product must be lifted prior to discharge. As will be seem by reference to FIG. 7, injection of air considerably improves the lift, with only a small increase in horse power required for this injection. Air pressure in the manifold 27, 27.1 and/or 28 typically is relatively low, i.e., between 5 and 10 PSI (34.5 kPa and 68.9 kPa), when compared with the higher pressure in the driving liquid manifold 14, which is within the range of 50 to 150 PSI (344 kPa and 1.03 MPa). Injection of air either upstream or downstream of the jet nozzles causes a dramatic increase in pump suction flow and performance with very small increase in power requirements to pressurize the air.

In one set of tests, the pumping apparatus 12 had an 8 inch (203 mm) diameter duct expandiang to a 12 inch (305 mm) outlet portion at lifts of 20 feet (6.1 meters) from waterline to discharge point. When the jet pump was used without air injection, the pump suction flow was measured as 650 USGPM (0.41 $m^3$/sec) at the inlet portion 16, and this required approximately 75 horspower (55.9 Kw) to drive the pump 23. When air was injected at approximately 100 CFM (0.0472 $m^3$/sec), using about 10 horsepower (7.5 Kw), the suction flow of the system at inlet portion 16 was doubled to 1300 USGPM (0.82 $m^3$/sec). This shows that the addition of a small energy increment in the form of power for compressing the air effectively doubled the performance of the pump. This improvement in performance is attributed to the fact that the buoyancy of air induces flow of pumped mixture which flows upwardly with it. Also, air mixing with water decreases the effective density of the resulting air and water mixture which allows the pump to operate at a lower pumping head at a more efficient point on its operating curve. Air flow was approximately 150 CFM per square foot of cross-sectional area (0.76 $m^3$/sec per square meter of cross-sectional area) of the transfer hose 31. The pressure requirements were only that required to overcome hose losses, and the static head within the hose 31. No additional benefits were measured when higher air flows were used.

FIG. 6

The graph of FIG. 6 supports the applicant's claims that the use of first and second jet nozzles of differing angles of a certain range provides improved benefits over a row of jet nozzles all at the same angle. The graph shows the relationship between input power, i.e., horsepower, determined at two different locations and suction velocity, measured in feet per second measured at the upstream opening 48. It was possible to make a direct comparison of the improvement in performance using a ring of jets all of the same angle which is similar to the prior art jet pumps, compared with a ring of jets of two separate angles as described herein. These tests were performed on the same duct of 10 inch (254 mm) diameter, generating a lift of 10 feet (3 m) without use of air injection for assistance. The axis angle of single angle prior art jet nozzle was 15°, whereas the first and second angles of the jets of the invention were 25 degrees and 18 degrees. In the single angle pump, the nozzle/duct area ratio was 10%, whereas in the two angle pump the area ratio was 9%. The minor differences in angles and area ratios are considered to be insignificant. The operating parameters for the four curves are as below.

| CURVE | ANGLE TYPE | INPUT POWER DETERMINATION POINT |
|---|---|---|
| A | Single angle, prior art | Engine 22 |
| B | Double angle, invention | Engine 22 |
| C | Single angle, prior art | Manifold 14 |
| D | Double angle, invention | Manifold 14 |

The curves A and B show that the total input power required at the engine 22, for the same suction flow, the double angle design of the invention requires about 25 horsepower (18.6 Kw) less than a single angle prior art pump. Curves C and D show a similar difference when power requirements are determined at the driving fluid manifold 14, with the invention requiring approximately 18 horsepower (13.4 Kw) less than a single angle pump. These graphs illustrate that efficiency gains at the jet nozzles have a magnifying effect due to other losses in the power delivery system, and will result in even greater power savings or pumping efficiency gains at the final drive unit.

FIG. 7

The graph of FIG. 7 shows six performance curves obtained when testing a propulsive apparatus 12 having an 8 inch (203 cm) diameter duct, in which the jet nozzle bore is 0.625 inch (15.9 mm), the first angle is 25° and the second angle is 18°. The graph compares suction velocity in feet per second, measured at the inlet portion 16, against jet pressure, measured in PSI at the manifold 14. These curves illustrate the effectiveness of the diverging outlet portion 18, termed diffuser and the use of air injection, which at this time was injected at the upstream inlet portion 16.

The operating parameters for the six curves of FIG. 7 are as below.

| CURVE | HEIGHT OF LIFT | AIR INJECTION | DIFFUSER |
|---|---|---|---|
| A | 11.5 feet (3.5 m) | No | No |
| B | 11.5 feet (3.5 m) | Yes | No |
| C | 11.5 feet (3.5 m) | No | Yes |
| D | 11.5 feet (3.5 m) | Yes | Yes |
| E | 20 feet (6 m) | No | Yes |
| F | 20 feet (6 m) | Yes | Yes |

As can be seen, the curve A is a datum or baseline curve, with no air injection or outlet diffuser. Curve B shows that air injection by itself i.e., without a diffuser, provides only a small efficiency improvement with slightly more suction. Curve C shows that the outlet diffuser, by itself, results in no significant change in power requirements. Thus air injection or an outlet diffuser when applied singly, has little effect. Curve D shows a considerable improvement by combining simultaneously air injection with the diffuser, which produces a large improvement in suction flow with the same input power, or therefore a large gain in pumping efficiency of the jet pump. Curve F shows a marked improvement when using air injection with an outlet diffuser over Curve E, which is the same lift height without air injection. Note that these last two curves relate to a higher lift than the previous four curves and it can be seen that air injection produces an even greater benefit than with the lower lifts.

This improvement in efficiency is attributed to the fact that the diffuser appears to reduce speed of the pump discharge such that the injected air is more effective in assisting the pumping action. This injection of air must be applied without loss of injected air around the outside of the pump, that is escaping from the inlet nozzle, especially when the air injection is applied at the inlet portion 16.

Field tests have shown that fish pumping rates as high as 65 tons per hour (16.4 kg/sec) with a 6 inch (152 mm) diameter duct causes minimal damage to herring. Softer species of fish and larger fish such as salmon can be handled with minimal damage at high pumping rates.

ALTERNATIVES AND EQUIVALENTS

As previously stated, the air injection is preferred upstream of the jet nozzles in conjunction with a diffusing outlet portion. Clearly air can be omitted totally or admitted alternatively or in addition to the inlet portion 16. While the device is shown using water as the main fluid other liquids or gases wuch as air can be substituted as the main fluid. However, if air or other gas were used as a substitute for the driving liquid, jet axes angles other than those listed and a change in duct or nozzle geometry would likely be required. Thus this invention is considered inappropriate for using a gas as the sole means of propelling the main fluid flow through the duct. While the first and second sets of jet nozzles are shown to alternate singly with each other around the periphery of the duct, the nozzles could alternate in pairs around the duct. That is, there would be a pair of nozzles having the first angle disposed between two pairs of nozzles having the second angle, and vice versa, around the duct. Thus, in summary, at least one nozzle of the first set alternates with at least one nozzle of the second set. The benefits of the invention appear to result from the intimate mixing of the jets of driving liquid from the two sets of nozzles which are closely adjacent each other peripherally as well as axially.

An important aspect of the invention relates to the two sets of jet nozzles in which the jet angles of inclination of one set are dissimilar to the jet angles of the other set. This provides benefits over a single set of jet nozzles all of the same jet angle. However a second aspect of the invention relates to air injection in combination with an outlet diffuser, i.e., the duct outlet portion diverges downstream from the mixing portion. This second aspect provides benefits in addition to the first aspect of the invention, however it could also provide benefits when used with a jet pump having one set of jet nozzles having jet axes inclined at similar angles to the duct axis. The jet nozzles could be inclined at angles of between 10° and 30° and would be adjacent a transverse plane of a duct having a mixture portion of constant cross-sectional area. These equal angled jet nozzles only of this alternative would resemble the jet nozzles of some prior art jet pumps.

While the device is shown for pumping fish from a net etc., it can be used to harvest sheel fish from the sea bed, or used as a propulsive apparatus to propel or displace floating vessels or vehicles.

What is claimed is:

1. A propulsive apparatus for displacing a main liquid, the apparatus having:

(a) a duct extending along a longitudinal duct axis for receiving the main liquid, the duct having a duct side wall to define in part a mixing portion having a constant cross-sectional area, the duct side wall also defining in part inlet and outlet portions spaced on upstream and downstream sides respectively of the mixing portion, (b) a driving liquid manifold cooperating with the duct and adapted to receive pressurized driving liquid, (c) first and second sets of inwardly facing jet nozzles disposed adjacent one transverse plane of the duct and being spaced equally from the duct axis, the jet nozzles having outlets essentially flush with the duct side wall and ajacent the mixing portion, the nozzles communicating with the manifold to pass the driving liquid into the mixing portion, the first and second sets of jet nozzles having respective first and second jet axes inclined at respective first and second angles to the duct axis to intersect the duct axis, in which the first angle is greater than the second angle, the first and second sets of jet nozzles alternating with each other and extending peripherally around the side wall so that at least one nozzle of the first set alternates with at least one nozzle of the second set, the two sets of jet nozzles having a total cross-sectional area which is within a range of approximately 3% to 15% of the cross-sectional area of the mixing portion.

2. An apparatus as claimed in claim 1 further including:

(a) a gas manifold cooperating with the duct and adapted to receive pressurized gas, (b) a portion of the duct side wall having a plurality of gas nozzles which communicate with the gas manifold to pass the gas into at least one of the duct portions.

3. An apparatus as claimed in claim 2 in which:

(a) the gas manifold contains pressurised air.

4. An apparatus as claimed in claim 1 in which:

(a) the outlet portion diverges downstream from the mixing portion so as to have a larger cross-sectional area than the mixing portion, and the apparatus further includes:

(b) a gas manifold adapted to receive pressurised gas and to cooperate with the duct, (c) a plurality of gas nozzles cooperating with the side wall of the duct and the gas manifold to pass the gas into the duct.

5. An apparatus as claimed in claim 4 in which:

(a) the mixing portion has a minimum axial length extending from the transverse plane containing the jet nozzles to the outlet portion, which axial length is approximately three times width of the mixing portion.

6. An apparatus as claimed in claim 4 in which:

(a) the gas manifold cooperates with a downstream portion of the outlet portion of the duct.

7. An apparatus as claimed in claim 4 in which:

(a) the gas manifold cooperates with an upstream portion of the outlet portion of the duct.

8. An apparatus as claimed in claim 1 in which:

(a) the first angle of the first nozzles is between 15 degrees and 30 degrees, (b) the second angle of the second nozzles is between 10 degrees and 20 degrees, (c) the first and second angles are separated by no less than about 5 degrees.

9. An apparatus as claimed in claim 1 in which:

(a) the first angle of the first nozzles is between 18 degrees and 25 degrees, (b) the second angle of the second nozzles is between 12 degrees and 19 degrees, (c) the first angle and the second angle are within a range of between 5 degrees and the 10 degrees of each other.

10. An apparatus as claimed in claim 1 in which:

(a) the side wall of the duct is relatively smooth adjacent the jet nozzles and is free of steps or significant changes in size to reduce turbulence or possible damage to the product being handled.

11. An apparatus as claimed in claim 1 in which:

(a) most of the inlet portion and all the mixing portion have a similar cross-sectional area.

* * * * *